United States Patent [19]

Reed

[11] 4,149,453

[45] Apr. 17, 1979

[54] NO-PLUME DEVICE

[75] Inventor: Robert D. Reed, Tulsa, Okla.

[73] Assignee: John Zink Company, Tulsa, Okla.

[21] Appl. No.: 788,738

[22] Filed: Apr. 19, 1977

[51] Int. Cl.[2] ..... F23L 17/02; F23J 13/00

[52] U.S. Cl. ..... 98/46; 98/47; 98/58; 432/72; 110/160; 110/184; 417/155; 417/179; 60/316

[58] Field of Search ..... 98/58–60, 98/66 R, 66 A, 45–48; 432/72; 126/312; 110/184, 160, 1 J, 1 K; 60/316; 431/10, 5; 239/432; 417/155, 179

[56] References Cited

U.S. PATENT DOCUMENTS

| | | | |
|---|---|---|---|
| 140,017 | 6/1873 | Cram | 417/179 |
| 944,170 | 12/1909 | Bernstein | 126/301 |
| 1,604,271 | 10/1926 | Friedman | 110/160 |
| 2,358,690 | 9/1944 | Decker | 417/179 |
| 2,397,870 | 4/1946 | Kneass, Jr. | 417/155 |
| 2,924,392 | 2/1960 | Von Ruling | 239/432 |
| 3,212,553 | 10/1965 | Cathala | 431/10 |
| 3,566,768 | 3/1971 | Walpole, Jr. | 98/58 |
| 3,570,423 | 3/1971 | Hemmingson | 98/60 |
| 3,643,581 | 2/1972 | Feldman | 98/58 |
| 3,695,192 | 10/1972 | Von Brimer | 110/160 |
| 3,893,810 | 7/1975 | Lientz | 431/5 |
| 3,947,215 | 3/1976 | Peterson et al. | 431/5 |
| 4,021,192 | 5/1977 | Ferguson et al. | 432/72 |

FOREIGN PATENT DOCUMENTS

| | | | |
|---|---|---|---|
| 669951 | 11/1929 | France | 110/184 |

*Primary Examiner*—Henry C. Yuen

*Attorney, Agent, or Firm*—Head, Johnson & Chafin

[57] ABSTRACT

An apparatus for discharging to the atmosphere, combustion gases containing sulphur trioxide, means are provided for injecting into the stream, prior to venting to the atmosphere, a selected quantity of diluting gas. The diluting gas and sulphur containing combustion gases are turbulently mixed to provide dilution of the sulphur trioxide in the combined effluent from the stack. In one embodiment, the diluting gases are injected through a pipe positioned axially in the stack, below the top. A column of diluting gas is injected at high velocity into the upwardly moving combustion gases to entrain, mix with, and dilute the sulphur trioxide in the combination gases prior to escape from the stack to the atmosphere. In an improved embodiment, an annular plenum is constructed around the stack at a point upstream of the top of the stack, and a plurality of pipes are directed inwardly radially and upwardly through the wall of the stack. Diluting gas is supplied to the plenum at substantial pressure, which flows through the pipes at considerable velocity into the rising column of combustion gases.

6 Claims, 5 Drawing Figures

NO-PLUME DEVICE

BACKGROUND OF THE INVENTION

1. Field of the Invention

This invention lies in the field of combustion of high sulphur containing fuels, with combustion gases containing substantial amounts of sulphur trioxide.

Still further, this invention involves means for the elimination of plumes of smoke from stacks, where the smoke plume has coloration other than the shades of black and grey, which are typical of the burning of combustible gases. Such plumes result from combustion of fuels which contain too-great quantities of sulphur. Cause of the plume is well known and is due to the presence of sulphur trioxide in the combustion gases as they are finally vented to the atmosphere.

2. Description of the Problem

When there is too great concentration of sulphur trioxide in vented combustion gases, the sulphur trioxide causes high temperature dew point, in which the gas condenses in minute micron-size droplets of dew point product, which is substantially sulphuric acid, if the PPM of sulphur trioxide and the partial pressure of water vapor permit. As an example, when the partial pressure of water vapor is 100 MM Hg and there are 80 PPM of sulphur trioxide, dew point temperature is 282° F., but at 50 MM Hg of water vapor, and 40 PPM of sulphur trioxide, the dew point falls to 253° F. It is then obvious, that if the combustion gases, for discharge to the atmosphere are diluted, the dew point temperature can be depressed, to facilitate further diffusion of the sulphur trioxide into the diluting gas before dew point temperature is reached. Thus, dew point can be depressed to a point where the resulting droplets of sulphuric acid are not produced, and the plume is avoided.

This effect of dilution in avoidance of dew point, is greatly enhanced if the diluent gases can be injected at higher temperature than that of the gases to be diluted, and a still further benefit in avoidance of dew point and sulphur plume, is realized if the warmer diluent gases are injected before discharge to the atmosphere.

All discussion to this point is predicated on the theorem that the diluent gases are injected into the diluted gases at greater flow velocity for the diluent gases, than for the diluted gases. Energy for the mixture of the diluent gases with the diluted gases, which is required for the effects desired, will vary as the square of the velocity differential or as:

$$M(V_2^2 - V_1^2)/2$$

In the formula $V_2$ is the diluent gas discharge velocity, and $V_1$ is the diluted gas velocity. In a typical stack $V_1$ exceeds 50 feet per second, and a preferred $V_2$ would be in the order of 100 feet per second. However, a lower $V_2$ is satisfactory so long as it significantly exceeds $V_1$.

SUMMARY OF THE INVENTION

It is a primary object of this invention to provide an apparatus whereby a diluent gas can be injected into a stack containing combustion gases from fuel containing sulphur, so as to dilute the sulphur trioxide in the combined effluent from the stack.

It is a further object of this invention to provide a means for intimately mixing diluent gas at substantial velocity with slower moving diluted, or combustion gas, so as to provide turbulent mixing and dilution of the sulphur trioxide in the combined effluent.

These and other objects are realized, and the limitations of the prior art are overcome in this invention, in which a diluent gas is injected into the combustion gas, in one embodiment of the invention, by means of an axial pipe of lesser diameter than the stack, which is positioned inside of the stack near its top end, through which the diluent gas is supplied at a pressure $P_2$ such that the velocity of the diluent gas $V_2$ will be substantially greater than the velocity $V_1$ of the diluted gas. Thus, there will be high speed injection of the diluent gas into the flowing stream of diluted gas, with turbulent mixing, and with dilution, and reduction of the concentration of sulphur trioxide in the combined effluent, as it flows out of the top of the stack.

In a preferred embodiment, the stack is constructed with a circular plenum surrounding the stack at a point below the top of the stack. There are a plurality of short, small-diameter pipes welded into openings in the side of the stack, and inclined at a selected angle radially inwardly and upwardly, so that the axes of the plurality of pipes will intersect substantially along the axis of the stack, at some distance above the plenum. The diluent gas is supplied to the plenum at a selected pressure, whereby the plurality of streams of gas flowing through the short pipes will be injected at higher velocity than the moving stream of diluted gas, and will turbulently mix with the diluted gas in its movement up the stack to the discharge point. Means are provided, if needed, for heating the diluent gas prior to injection into the diluted gas, so as to prevent cooling below the dew point of the sulphur trioxide, in the presence of water vapor in the diluted gas.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
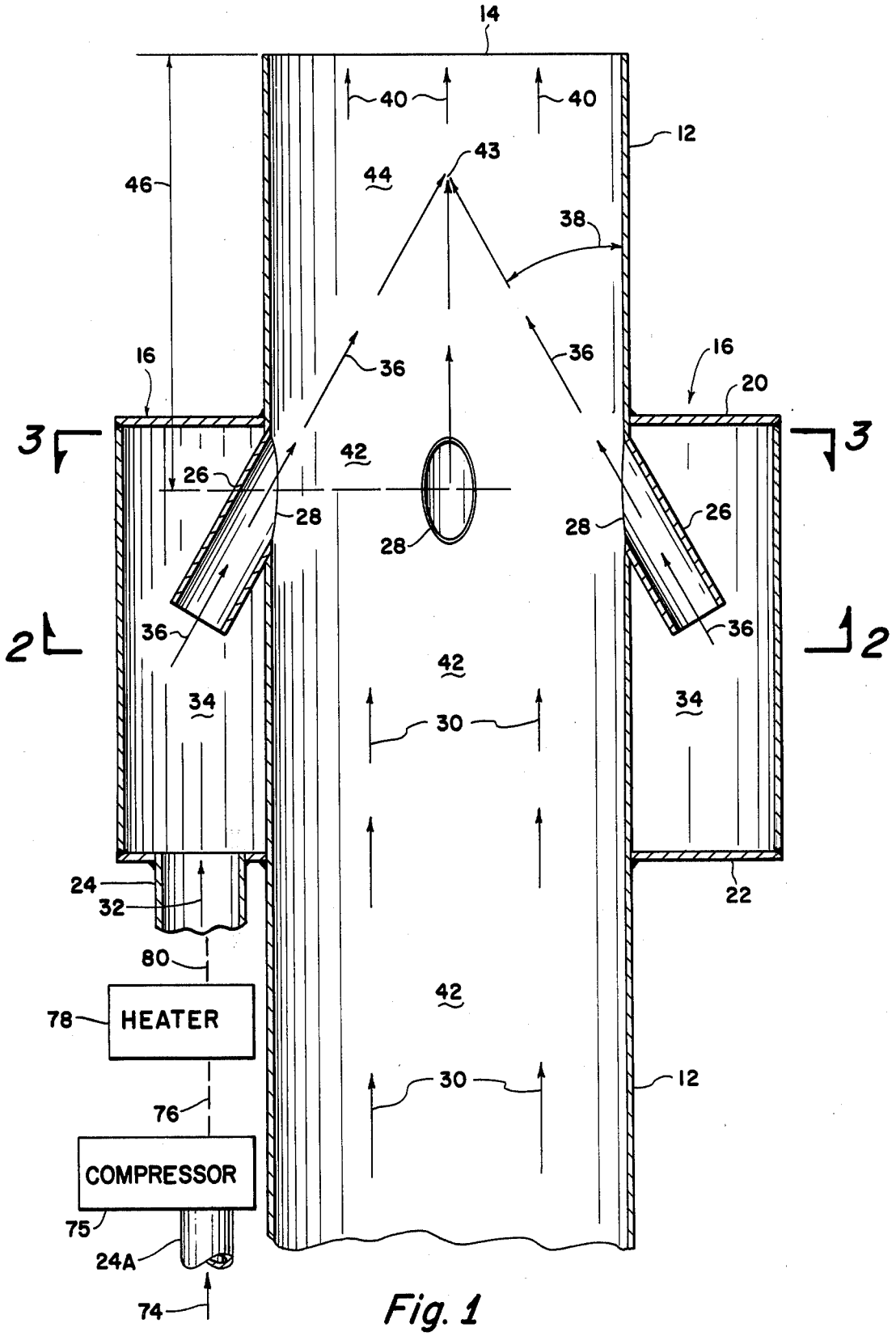
FIG. 1 illustrates in vertical section a preferred embodiment of this invention.

Referring now to the drawings and in particular to FIG. 1, there is shown one embodiment of this invention.

The discharge stack 12 is constructed of steel plate and is in the form of a right circular cylinder, with vertical axis, and having an open top 14. Combustion gases from a fuel burning device, (not shown) wherein the fuel has a high sulphur content, will flow in accordance with arrows 30 up through the stack toward the top 14. In the absence of any diluting gas, and dependent upon the concentration of sulphur trioxide in the gas 30, the combustion gases will be cooled by contact with the cooled atmospheric gases, and, dependent upon the concentration of sulphur trioxide and the water vapor pressure, there will be a definite dew point.

If the gases are cooled below that dew point, micron-sized droplets of sulphuric acid will be condensed, and these droplets will form a colored plume, different from the conventional shades of gray smoke, due to carbon in the effluent, and will provide an unsatisfactory environmental condition.

The correction for this situation is to provide a diluting gas for intimate mixture with the diluted gas 30 at a point upstream of the top 14 of the stack. Thus the reduced concentration of sulphur trioxide in the combined diluent and diluted gases, will be such that the dew point will be depressed below the temperature of the effluent gases after they have been injected into the atmosphere.

This injection of diluent gas is provided by a plurality of small pipes 26 which are inserted into openings 28 of the wall of the stack 12, and welded in position. Each of the pipes is in a radial plane, and is directed upwardly at a selected angle 38 to the axis of the stack 12. Thus, the axes 36 of the pipes 26 will meet at a point 43 along the axis of the stack, and from that point on, any gases which flow through the pipes 26 will form a combined diluent and diluted gas mixture in the space 44 above the openings, or ports 28. The sulphur trioxide will be diluted in the total flow 40 as it progresses upwardly through the stack and into the atmosphere at the top 14.

The distance 46 below the top 14 at which the ports 28 are positioned is not critical, but should provide sufficient distance of travel of the combined diluent and diluted gases so that mixing can be complete by the time it flows into the atmosphere. The preferred position of the point 43 is, of course, below the top 14. However, the angle 38 may be such that the junction point 43 of the several streams can be above the top 14.

A circular cylindrical plenum 16 is constructed on the outside of the stack 12, which encloses the plurality of pipes 26. A supply pipe 24 is sealed into the plenum through which diluent gas flows in accordance with the arrow 32 into the space 34 inside the plenum, and then in accordance with arrows 36 flows into the space 42 inside of the stack, to mix therewith the combustion gases 30.

It will be clear that there must be substantially greater velocity $V_2$ to the flow 36 of the diluent gas, than the velocity $V_1$ of upward flow of the combustion gas 30, in order to get mixing of the two. This results from the fact that the energy required for mixing varies as the square of the velocity and the value of $V_2$ the velocity of the diluent gas, should preferably be at least twice that of the diluted gas containing the sulphur oxide.

As has been described previously, the dew point of the sulphur trioxide and water vapor in the effluent gas is a function of the concentration of the sulphur trioxide and of the water vapor partial pressure. The object, of course, is to keep the concentration sufficiently low and the temperature of the gas mixture sufficiently high, so that it will not reach the dew point, and therefore there will be no droplets of sulphuric acid formed, to be visible as a plume.

The use of the pipes 26 for injecting the diluent gas at substantial pressure, provides the energy for mixing and dilution. It is also possible to use a diluent gas, which can be any non-combustible gas that is not sulphur containing, that has a substantial temperature, so that in mixing with the combustion gas it does not cool it below the dew point. In this regard, if such hot diluent gas is not available, a heater can be utilized at times when the atmospheric temperature is very low, so that the diluent gas can be heated prior to injection into the stack. Such a heater is not shown in FIG. 1 or in FIG. 4, but would be upstream of the inlet pipe 24, for example, in FIG. 1 so that the gas indicated by 32 would be warmed to a sufficient temperature.

In FIG. 1 the diluent gas shown by arrow 74 passes through inlet pipe 24A to a gas compressor of conventional type 75 then through means 76 to heater 78, to the inlet pipe 24 of the plenum 16, flowing in accordance with arrow 32. The gas entering the plenum can thus be supplied at any selected temperature, and selected pressure P2.

Figure 2:
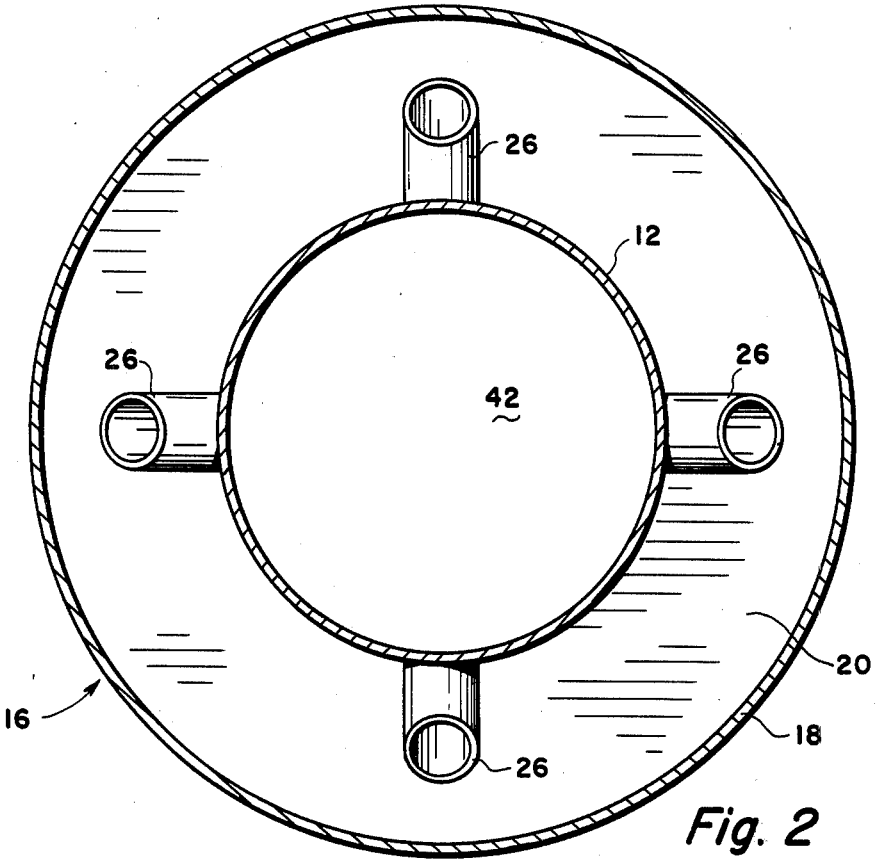
FIGS. 2 and 3 illustrate horizontal cross-sectional views of the embodiment of FIG. 1, taken along the planes 2—2 and 3—3.
Figure 3:
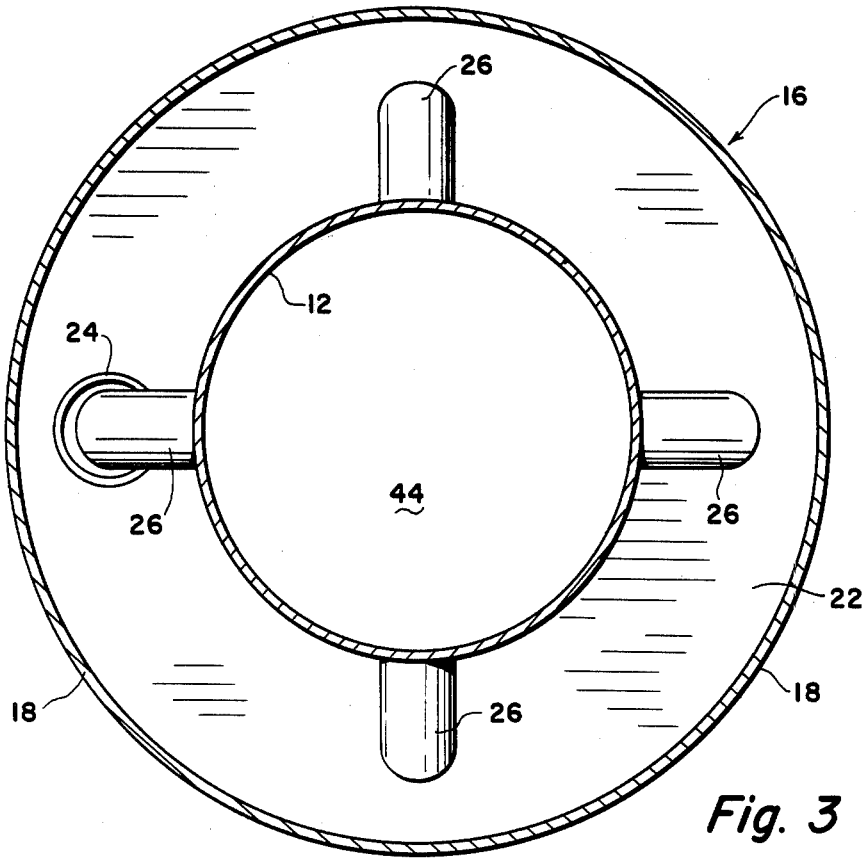
Figure 5:
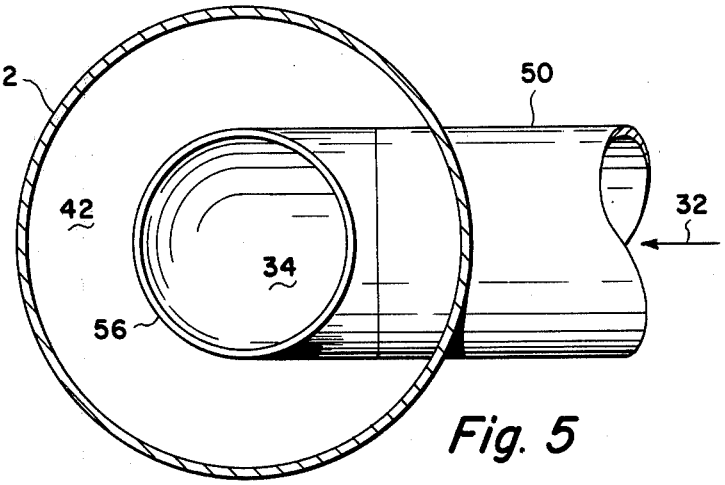
FIG. 5 illustrates a horizontal cross-section of the embodiment of FIG. 4 taken along the plane 5—5.

Referring to FIG. 2 which is a cross-section of FIG. 1 taken along the plane 2—2, and FIG. 3 which is a cross-section of FIG. 1 taken along the plane 3—3 there are shown two cross-sections of the structure of FIG. 1, which further clarify the construction. Like elements are indicated by the same numerals, so that no further description is necessary.

Figure 4:
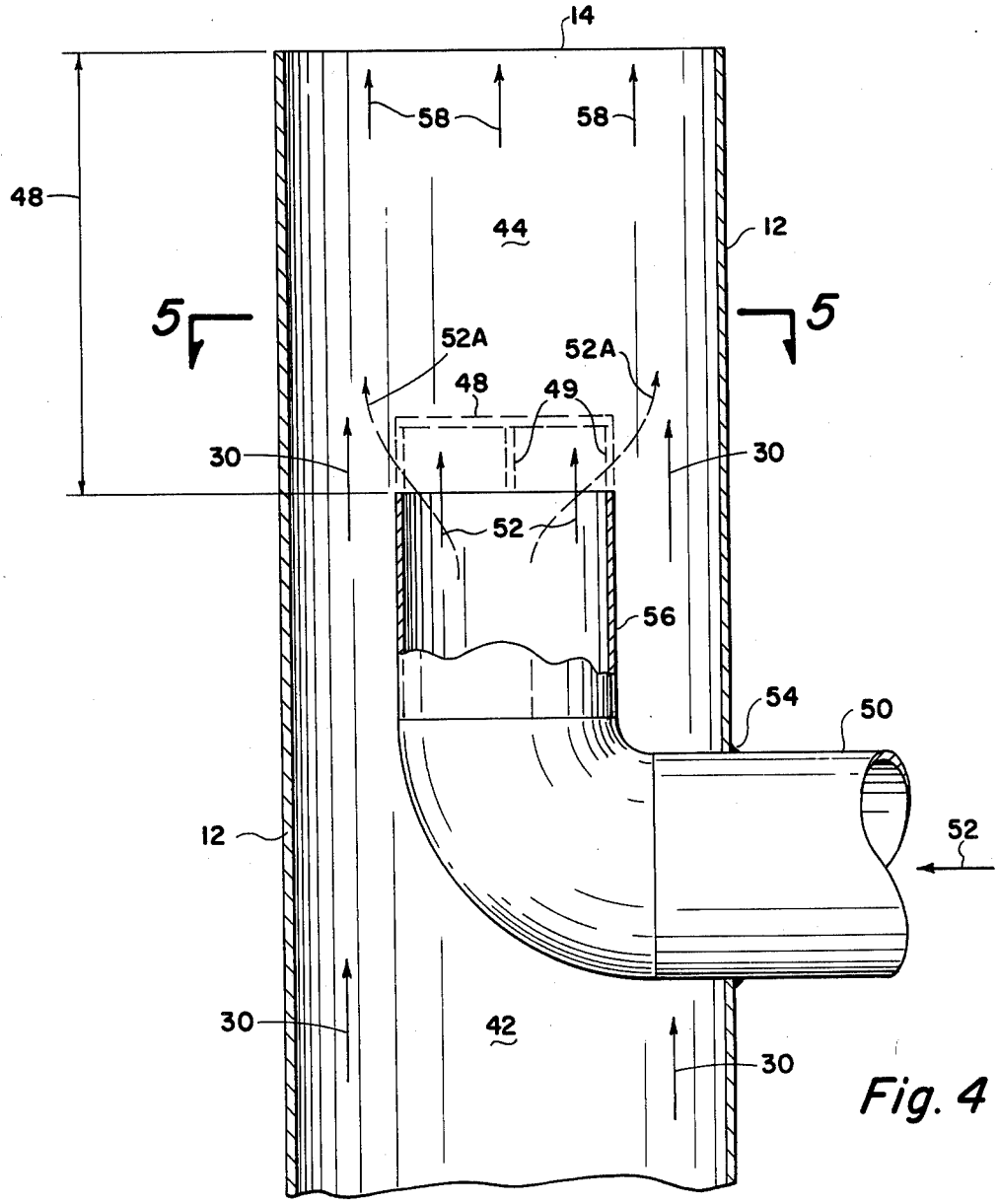
FIG. 4 illustrates a second embodiment in vertical section.

Referring now to FIG. 4, there is shown a second embodiment of this invention, where the diluent gas is injected by a single pipe 56, which is positioned on the axis of the stack 12, and a selected distance 48 below the top 14 of the stack. As in FIG. 1, the combustion gases flow up the stack in accordance with arrows 30, in the space 42. The diluent gas flows into the pipe 50 through the seal 54, as by welding, and through an ell and into the pipe 56, which is positioned on the axis. The diluent gas flows in accordance with arrows 52 at a higher velocity $V_2$ than the velocity $V_1$ of the stack gas 30, which flows in an annular space between the pipe 56 and the stack 12.

The energy of the diluent gas is such that there will be intimate mixing along the inner wall of the annular flow of rising gas, so that intimate mixing will take place, and will cause the dilution of the sulphur trioxide in the stack gases 30.

As shown by the dashed lines, it is possible to provide a cap 48 over the top of pipe 56, supported by legs 49. This will cause the diluent gas to flow upwardly and outwardly in accordance with arrows 52A, to promote more intimate mixing of the diluent and diluted gases.

The combined gases 52 and 30 co-mingle in the space 44 and proceed upwardly in the stack in accordance with arrow 58, and then are injected into the atmosphere at the top 14 of the stack. As in the case of FIG. 1, any suitable gas, and preferably at appreciable pressure and temperature, can be used for the diluent gas 52 that flows into the pipe 50. If necessary, the diluent gas can be heated by conventional means (not shown) prior to injection into the pipe 50 and into the stack.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. Apparatus for treating stack gases resulting from combustion of high sulphur containing fuel, and which contain substantial content of $SO_3$, comprising;

(a) a stack for carrying the combustion gases upwardly for discharge into the atmosphere, said gases flowing at velocity $V_1$;

(b) means for injecting into said flow of combustion gases at least one jet of diluent gas, at a velocity $V_2$, where $V_2$ is substantially greater than $V_1$;

(c) the injection point being at a selected distance upstream of the top of said stack;

(d) said at least one jet of diluent gas being directed into said stream of combustion gas to provide maximum mixing of said diluent and combustion gases;

whereby the concentration of $SO_3$ is reduced and the dew point depressed below the expected temperature of the combined gas flow when the effluent reaches the atmosphere; and including (e) a plurality of short small diameter pipes sealed into the wall of said stack, said pipes directed radailly inwardly and upwardly, and circumferentially spaced;

(f) a cylindrical plenum on the outside of said stack and enclosing said short pipes, said plenum and pipes positioned a selected distance below the top of said stack;

(g) means to supply diluent gas to said plenum at a pressure $P_2$ such that the jet velocity of diluent gas $V_2$ in said pipes will be substantially greater than the velocity $V_1$ of said combustion gas rising in said stack.

2. The apparatus as in claim 1 including means to heat said diluent gas before injection into said combustion gases in said stack.

3. The apparatus as in claim 1 in which $V_2$ is at least equal to $2V_1$.

4. The apparatus as in claim 1 in which $V_2$ is measurably greater than $2V_1$.

5. The apparatus as in claim 1 including means to pressurize said diluent gas to said pressure P2.

6. The apparatus as in claim 1 in which said diluent gas is any non-combustible gas which is not sulphur containing.

* * * * *